US010094349B2

(12) United States Patent
Avireddi

(10) Patent No.: US 10,094,349 B2
(45) Date of Patent: Oct. 9, 2018

(54) FLUID VALVE ASSEMBLY

(71) Applicant: Hitachi, Ltd, Tokyo (JP)

(72) Inventor: Prashanth Avireddi, Farmington Hills, MI (US)

(73) Assignee: Hitachi, Ltd., Tokyo (JP)

( * ) Notice: Subject to any disclaimer, the term of this patent is extended or adjusted under 35 U.S.C. 154(b) by 559 days.

(21) Appl. No.: 14/272,595

(22) Filed: May 8, 2014

(65) Prior Publication Data

US 2015/0322908 A1 Nov. 12, 2015

(51) Int. Cl.

| | |
|---|---|
| ***F02M 69/46*** | (2006.01) |
| ***F02M 59/48*** | (2006.01) |
| ***F02M 63/02*** | (2006.01) |
| ***F02M 59/46*** | (2006.01) |

(52) U.S. Cl.

CPC ..... *F02M 59/485* (2013.01); *F02M 59/462* (2013.01); *F02M 63/0225* (2013.01); *F02M 63/0265* (2013.01)

(58) Field of Classification Search

CPC ..... F02M 59/485; F02M 59/462; F02M 63/0225; F02M 63/0265; F02M 59/00

USPC ..... 123/456, 445, 446; 251/318, 321

See application file for complete search history.

(56) References Cited

U.S. PATENT DOCUMENTS

| | | | | |
|---|---|---|---|---|
| 7,484,673 | B2 * | 2/2009 | Boecking | F02M 45/04 239/102.2 |
| 2006/0196562 | A1 * | 9/2006 | Curello | F16K 15/063 137/614.04 |
| 2011/0123376 | A1 * | 5/2011 | Aritomi | F02M 59/462 417/540 |
| 2012/0248362 | A1 * | 10/2012 | Williamson | F16K 17/04 251/321 |
| 2013/0126770 | A1 | 5/2013 | O'Brien | |

FOREIGN PATENT DOCUMENTS

| | | | | |
|---|---|---|---|---|
| CA | 2580392 | A1 | 4/2006 | |
| DE | 102011007178 | A1 | 10/2012 | |
| GB | 665932 | A * | 2/1952 | F02M 59/00 |
| WO | 2009016756 | A1 | 2/2009 | |
| WO | 2013012619 | A1 | 1/2013 | |

* cited by examiner

*Primary Examiner* — Lindsay Low
*Assistant Examiner* — Omar Morales
(74) *Attorney, Agent, or Firm* — Mattingly & Malur, PC

(57) ABSTRACT

A fluid valve assembly having a housing with a valve seat which forms a fluid port. A valve is movable along an axis relative to the port between an open and a closed position. This valve includes a protrusion complementary in shape to, but slightly smaller than, the port. The protrusion is at least partially positioned in the port when the valve is in its closed position at which time a clearance space between the port and the protrusion is sufficiently small to prevent fluid flow through the port. A main spring disposed between the housing and the valve resiliently urges the valve towards its closed position. A second spring is also operatively positioned between the valve and the housing which urges the valve away from the valve seat towards its open position and prevents contact between the valve and the valve seat.

20 Claims, 3 Drawing Sheets

FLUID VALVE ASSEMBLY

BACKGROUND OF THE INVENTION

I. Field of the Invention

The present invention relates generally to fluid valve assemblies and, more particularly, to a fluid valve assembly of the type used in fuel pumps for internal combustion engines.

II. Description of Material Art

Modern day internal combustion engines of the type used in automotive vehicles typically use fuel injectors in order to inject the fuel into the fuel combustion chamber. Many modern day internal combustion engines, furthermore, are direct injection engines in which the fuel injectors are open directly to the internal combustion chamber.

During the operation of the engine, in order to overcome the high pressures present within the internal combustion chamber of the direct injection engine, the fuel must be delivered to the fuel injectors at a high fuel pressure. Conventionally, a high pressure fuel pump provides fuel to a fuel rail which extends along the fuel injectors. Each fuel injector is then fluidly connected to the interior fuel chamber of the fuel rail by an injector fuel port and fuel cup.

In order to achieve the high pressures necessary for the fuel injection of a direct injection engine, many previously known fuel pumps utilize a reciprocating piston within a fuel chamber in a fuel pump housing. This piston both inducts fuel from a fuel source or fuel tank during the induction stroke, and also pumps fuel from the fuel chamber out through an outlet check valve and to the fuel rail. Typically, these pistons utilize a cam lobe which is rotatably driven in synchronism with the engine so that the outer cam surface mechanically displaces the pump piston and reciprocally drives the pump piston in the pump chamber.

While these previously known direct injection internal combustion engines enjoy high efficiency, fuel economy, and other advantages, one disadvantage of such engines is that the fuel pressure pulsations within the fuel delivery system create both vibration and noise from the engine. This noise is particularly audible at low engine speeds, such as idle.

A major source of noise within the previously known fuel delivery systems arises from the operation of the outlet check valve for the fuel pump for the engine. The outlet check valve typically comprises a metallic valve which is urged towards a closed position and against a valve seat by a compression spring. During the pump or pressure cycle of the fuel pump, the pressure within the pump chamber forces the outlet valve open against the force of the spring and allows fuel to flow past the valve and to the fuel rails for the fuel injectors. Conversely, during the suction stroke of the pump pistons, the force of the compression spring urges the outlet valve against the valve seat due to the reduced pressure within the pump chamber. This cycle is then continuously repeated during the operation of the engine.

The outlet check valve from the fuel pump, however, forms a major source of noise in the fuel delivery system. This noise is due primarily to two different components.

First, the outlet check valve as well as the valve seat are typically constructed of metal for durability. Consequently, the repeated impact of the valve against the valve seat during each full cycle of the fuel pump piston creates a clicking sound which can often be heard at low engine speeds.

A second source of noise in the fuel delivery system attributable to the opening and closure of the outlet check valve from the fuel pump arises from fuel cavitation as the check valve is moved from its closed and to its open position. In particular, the fuel pump housing which forms the fuel outlet port from the fuel pump is typically constructed with a sharp edge. Consequently, once the valve is moved to its open position, the rapid flow of the fuel past the sharp edge of the port creates cavitation in the fuel which, in turn, creates noise.

A still further source of noise in the fuel delivery system arises from pressure pulsations within the fuel delivery system.

SUMMARY OF THE PRESENT INVENTION

The present invention provides a fluid valve assembly which is particularly suitable for use as the outlet check valve in a fuel pump for an internal combustion engine which overcomes all of the above mentioned disadvantages of the previously known fluid valve assemblies.

In brief, the fluid valve assembly of the present invention comprises a fuel pump housing which not only defines the fuel pump chamber but also a valve seat which forms a fuel outlet port from the housing. The outlet port, in turn, is fluidly connected to the fuel rail or rails for the internal combustion engine.

An outlet check valve is movable along an axis relative to the port between an open and a closed position. This valve includes a protrusion complementary in shape but slightly smaller than the port. This protrusion, furthermore, is at least partially positioned within the port when the valve is in its closed position. The clearance between the port and the protrusion when the valve is in its closed position is sufficiently small to prevent fluid flow through the port.

A main spring is disposed between the housing and the valve which urges the valve towards its closed position. This main spring further compresses upon opening of the outlet valve in response to pressure within the pump chamber of the housing during the pump cycle of the pump. Preferably, the main spring is a helical compression spring.

A second spring is operatively positioned between the valve and the housing which urges the valve away from the valve seat and thus urges the valve in the opposite direction than the main spring. The main spring has a spring constant greater than the spring constant of the spring member so that the closing force of the main spring overcomes the opening force of the second spring. The second spring, however, prevents the valve from contacting the valve seat upon valve closure during operation of the fuel pump.

Preferably, the second spring comprises a helical compression spring which is wound around the valve and is coaxial with the main spring. However, other types of second springs, such as an elastomeric tube, may alternatively be used for the second spring.

Since the second spring prevents the valve from contacting the valve seat when the valve is in its closed position, any and all noise which might otherwise be caused by impact of the valve member against the pump housing around the valve seat is completely eliminated. Furthermore, unlike the previously known outlet check valves used in fuel pumps, contact between the valve and the valve seat is not required to preclude fluid flow through the port due to the interaction of the protrusion and the pump housing at the outlet port.

In order to reduce or eliminate cavitation of the fuel during operation of the fuel pump, both the valve seat as well as the distal end of the valve protrusion are rounded about substantially the same radius. As such, as the valve opens during the pump cycle of the pump piston, fluid flow through the space between the valve protrusion and the valve seat is evenly distributed without abrupt pressure changes which would otherwise be caused by sharp edges on either the valve protrusion or the valve seat. As a result, cavitation is reduced or altogether eliminated together with the noise from such cavitation.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF PREFERRED

Embodiments of the Present Invention

Figure 1:
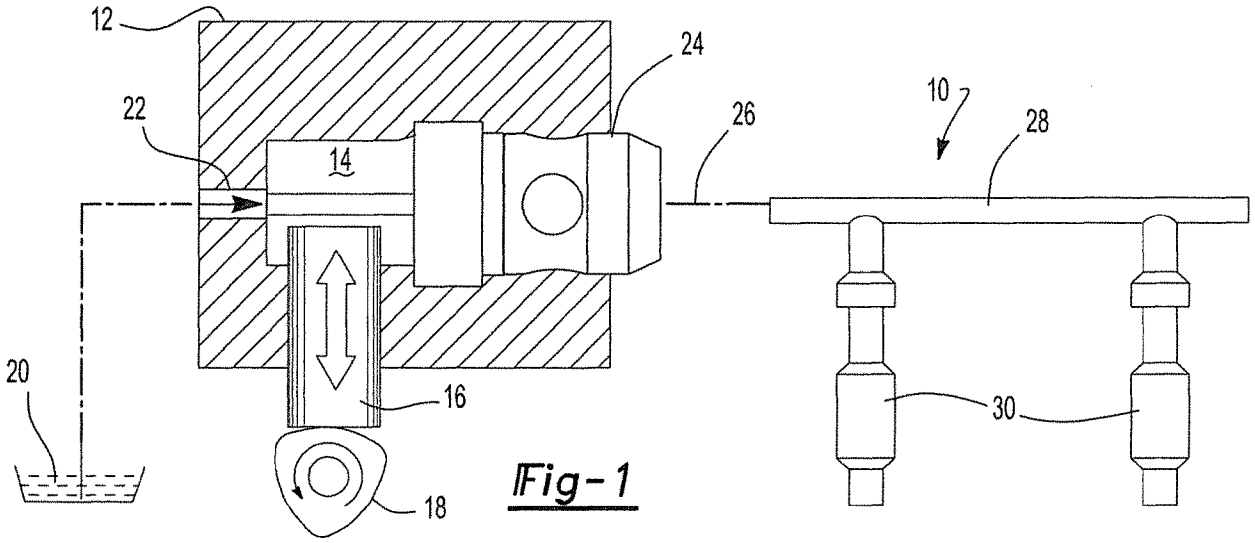
FIG. 1 is a diagrammatic view illustrating a fuel delivery system of the type used in an internal combustion engine.

With reference first to FIG. 1, a diagrammatic view of a fuel system 10 of the type used in automobiles is shown. One such type of internal combustion engine is a spark ignition direct injection internal combustion engine. Direct injection engines have enjoyed increasing popularity due to their fuel economy and efficient operation.

The fuel system 10 includes a fuel pump 12 having a housing 13 which forms an internal fuel pump chamber 14. A pump piston 16 is reciprocally mounted within the pump chamber 14 and is rotatably driven by a cam 18. The cam 18, furthermore, is rotatably driven in synchronism with the revolution of the engine.

A source 20 of fuel, such as a fuel tank, supplies fuel to the pump chamber 14 through a one-way inlet valve 22. This inlet valve 22 is a check valve which opens when the pressure within the pump chamber 14 is less than the pressure at the fuel source 20. Consequently, during the intake stroke of the piston 16, the pressure within the pump chamber 14 is reduced thus inducting fuel from the fuel source 20, through the inlet valve 22, and into the pump chamber.

During the pump stroke of the piston 16, i.e. when the piston 16 is driven into the pump chamber 14, the increased pressure in the pump chamber 14 closes the inlet valve 22. At the same time, the increased pressure opens an outlet check valve 24 which is open to the pump chamber 14. The outlet from the outlet valve 24 is, in turn, connected through a fuel supply line 26 to a fuel rail 28. One or more fuel injectors 30 are then fluidly connected to the fuel rail 28 so that, when actuated, the fuel injectors 30 provide fuel to their associated combustion chamber.

Figure 4:
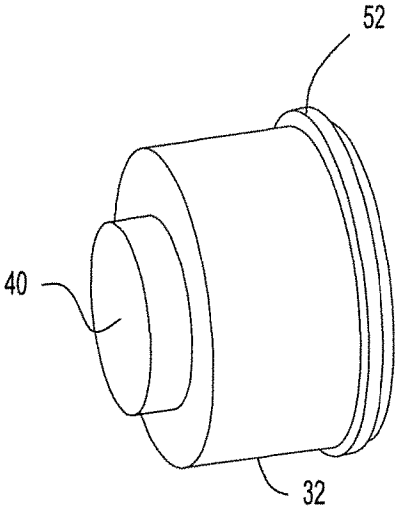
FIG. 4 is an elevational view illustrating the check valve.
Figure 2:
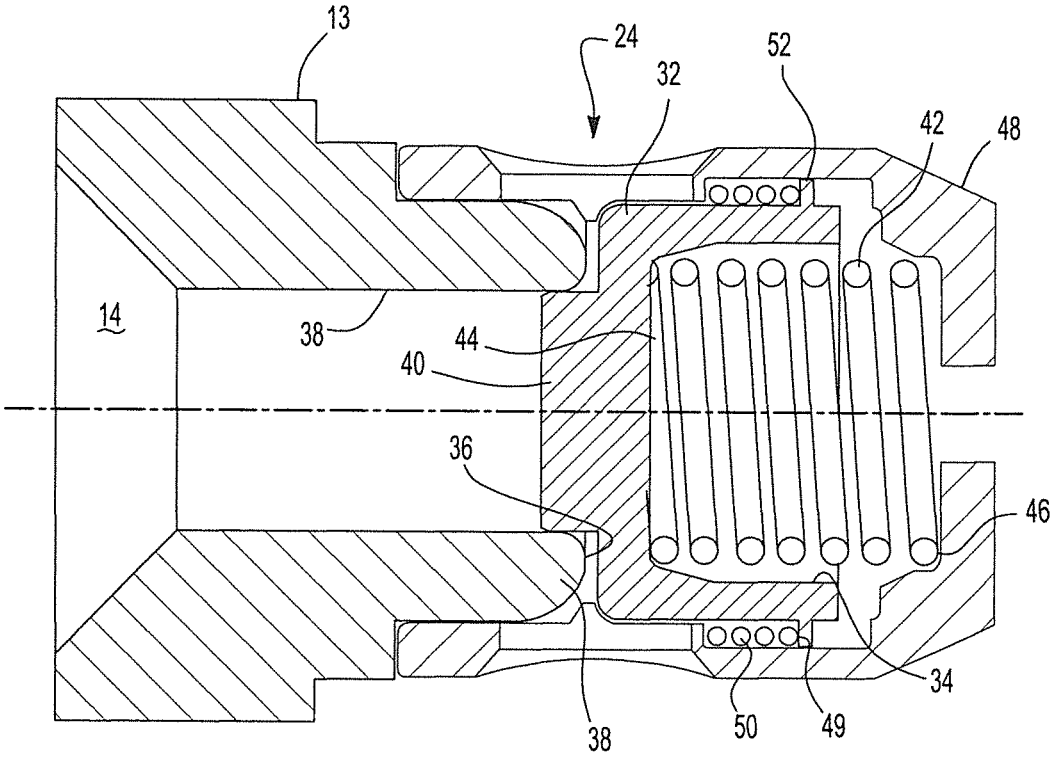
FIG. 2 is a longitudinal sectional view illustrating a preferred embodiment of the outlet check valve in a closed position.
Figure 3:
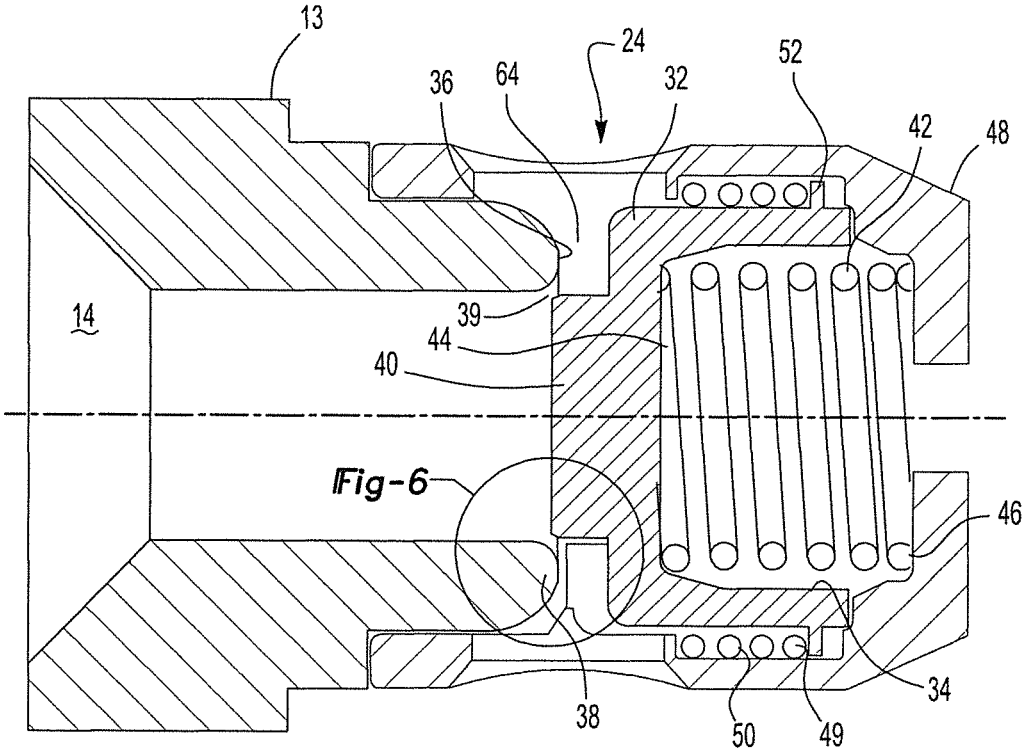
FIG. 3 is a view similar to FIG. 2, but illustrating the outlet check valve in an open position.

With reference now to FIGS. 2-4, the outlet valve 24 is there shown in greater detail and includes a valve 32 that is circular in cross-sectional shape and is generally cup shaped thus having an interior cylindrical cavity 34. The valve 32, furthermore, is aligned with a valve seat 36 formed in the pump housing 13. Consequently, the valve seat 36 forms a port 38 through which fuel flows from the pump chamber 14, past the outlet valve 32, and out to the fuel rail 28.

The valve 32 includes an axial protrusion 40 at its end facing the valve seat 36. This protrusion 40 is circular in cross section and thus has a shape complementary to the circular port 38. Furthermore, the protrusion 40 is only slightly smaller in diameter than the circular port 38, e.g. less than 0.1 millimeter, so that with the protrusion 40 positioned within the port 38 as shown in FIG. 2, the protrusion 40 effectively prevents fluid flow through the port 38. Conversely, when the valve 32 is in its open position as shown in FIG. 3, the protrusion 40 is spaced from the port 38 thus creating an opening 39 between the valve 32 and the port 38 and allowing the free flow of fluid from the pump chamber 14, through the port 38, and to the fuel rail 28.

A main compression spring 42 has one end positioned within the valve cavity 34 so that one end 44 of the main spring 42 abuts against the valve 34 while the other end 46 of the main spring 42 abuts against a valve housing 48. The valve housing 48, in turn, is attached to the pump housing 13. The main spring 42, furthermore, is a compression spring and thus urges the valve 32 towards its closed position as shown in FIG. 2.

Referring now particularly to FIGS. 2 and 3, a second spring 50 is coaxially positioned around the valve 32 and thus is also coaxial with the main spring 42. Preferably, the second spring 50 comprises a helical compression spring having a spring constant less than the main spring 42.

One end 49 of the second spring 50 is attached to the valve 32 against axial movement by a flange 52 which extends radially outwardly from the valve 32. The other end of the second spring abuts against the valve housing 48. Consequently, the second spring 50 compresses as the valve moves from its open and towards its closed position while the main spring 42 compresses as the valve 32 moves from its closed position and towards its open position.

Since the force of the second spring 50 acts in the opposite direction than the main spring 42, the second spring 50 effectively prevents the valve 32 from contacting the valve seat 36. Instead, the second spring 50 limits the maximum travel of the valve member 32 towards its closed position and thus ensures that the valve 32 does not contact the valve seat 36. However, even if the valve 32 does not contact the valve seat 36, only a line contact, indicated at 33 in FIG. 5, occurs which minimizes the area of contact and thus audible noise.

Figure 5:
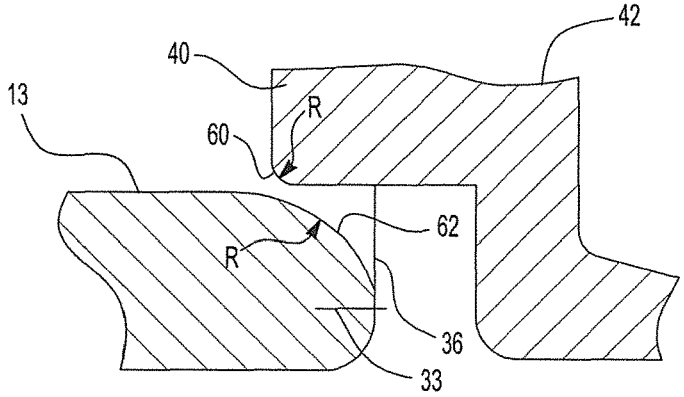
FIG. 5 is a view taken around circle FIG. 5 in FIG. 3 and enlarged for clarity.

With reference now to FIGS. 3 and 5, when the valve moves to its open position as shown in FIG. 3, an outer edge 60 of the valve protrusion 40 is spaced from an inner circular edge 62 of the valve seat thus permitting free flow of fluid through the valve port 38. Furthermore, as best shown in FIG. 5, both the outer edge 60 of the valve protrusion 40 as well as the inner edge 62 of the valve seat 36 are rounded along substantially the same radius R thereby eliminating sharp edges along the flow path for the fuel through the port 38. In doing so, cavitation of the fuel upon valve opening is minimized or altogether eliminated.

As best shown in FIG. 3, as the valve 32 moves from its closed and to its open position a relatively large annular volume or intermediate fluid chamber 64 is formed around the valve protrusion 40 in line with the valve seat 36. This relatively large volume 64 reduces the velocity change of the fuel during the initial flow of fuel through the fuel port 38 and thus reduces pressure pulsations within the fuel system 10.

Figure 7:
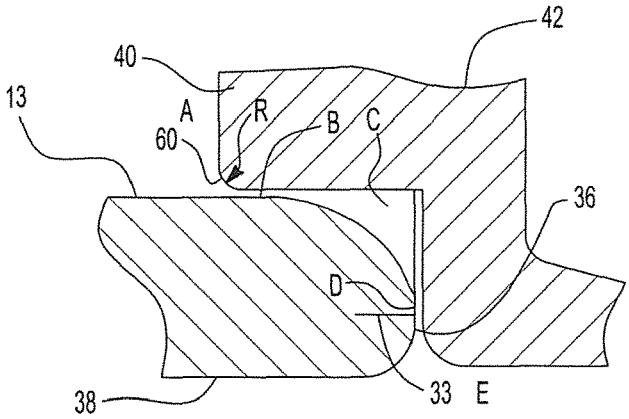
FIG. 7 is a view similar to FIG. 5, but showing the valve in a closed position.

With reference now to FIG. 7, the valve 42 is illustrated in its closed position. Since the protrusion 40 is smaller in diameter than the port 38 by a small amount, the protrusion does not contact the housing 13 and instead forms a fluid volume B which is in communication with a pump chamber volume A. Similarly, since the valve 42 does not contact the valve seat 36 in the closed position, a fluid volume D is formed between the valve 42 and the valve seat 36 which is open to the fluid volume E of the fuel rail 28. Both fluid volumes B and D are also open to a larger fluid volume C formed between the valve 42 and valve seat 36.

Since the fluid volumes A-E are fluidly connected even when the valve 42 is closed, albeit through restricted fluid volumes B and D, the pressure drops gradually from fluid volume A to fluid volume E, i.e. $P_A>P_B>P_C>P_D>P_E$ where P=pressure. This gradual reduction in pressure reduces cavitation, vibration, and pressure pulsations and thus reduces noise.

In operation, the cam 18 (FIG. 1) continuously reciprocally drives the pump piston 14. The pump piston 14 thus effectively inducts fuel from the fuel source 20 during its intake stroke and, during its outtake stroke, forces the outlet valve 24 to an open position (FIG. 3) against the force of the main compression spring 42. Conversely, during the intake stroke of the pump piston 16, the valve 32 moves to its closed position thus preventing the return of fuel from the fuel rail back to the fuel pump chamber 14. However, since the second spring 52 prevents the contact between the valve 32 and the valve seat 36, noise from impact of the valve against the valve seat is completely eliminated.

As previously described, the provision of the rounded edges 60 and 62 for the valve protrusion 40 and valve seat 36, respectively, reduces or altogether eliminates cavitation within the fuel system during the pump stroke of the pump piston. Elimination of cavitation not only reduces noise from the fuel delivery system 10, but also eliminates erosion of the valve seat 36 and/or the valve 32. Furthermore, the provision of the relatively large volume 64 surrounding the valve protrusion 40 during valve opening minimizes pressure pulsations within the fuel delivery system 10 as well as the resultant noise and mechanical wear and tear from such pressure pulsations.

Figure 6:
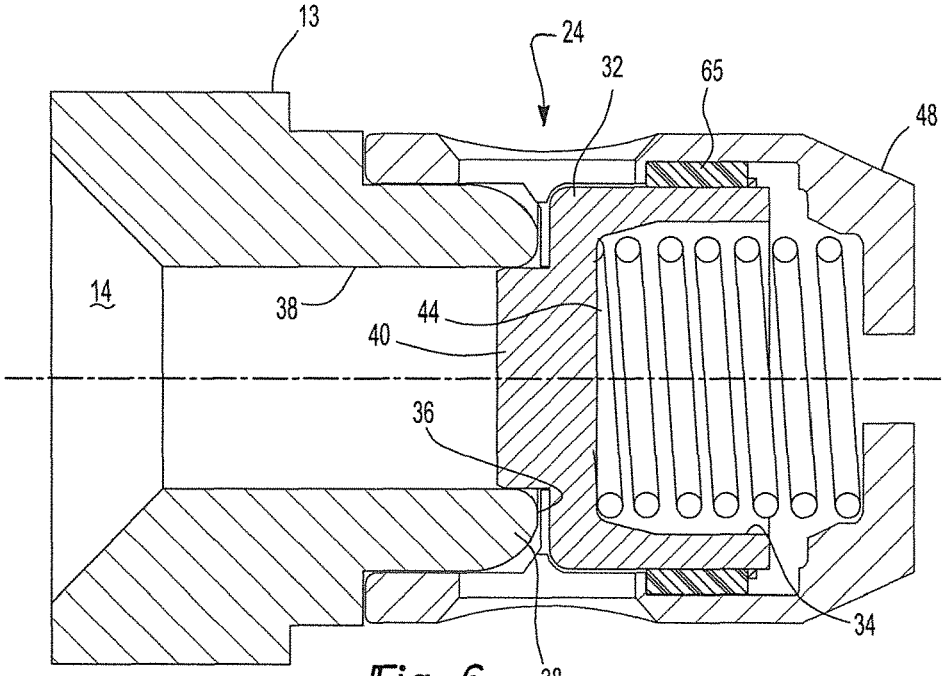
FIG. 6 is a view similar to FIG. 2, but illustrating a modification thereof.

With reference now to FIG. 6, while the second spring 50 is preferably a helical compression spring, alternatively the spring member 50 may comprise a tubular cylindrical elastomeric sleeve 65. This elastomeric sleeve 65 will thus compress during closing of the valve 32 and prevent the valve 32 from mechanically contacting the valve seat 36 as previously described.

From the foregoing, it can be seen that the present invention provides a unique one-way check valve which is particularly suitable for use as the outlet valve in a fuel pump for a fuel injected internal combustion engine. Having described our invention, however, many modifications thereto will become apparent to those skilled in the art to which it pertains without deviation from the spirit of the invention as defined by the scope of the appended claims.

I claim:

1. A fluid valve assembly comprising:

a housing forming a hollow cylindrical port of a first diameter having a circular valve seat at an opening thereof, a valve movable along an axis relative to said hollow cylindrical port between an open and a closed position, said valve being circular facing the circular valve seat, said valve having a first portion of a second diameter and a cylindrical protrusion extending from the first portion of a third diameter that is less than said second diameter, wherein said cylindrical protrusion is complementary in shape to said hollow cylindrical port and said third diameter of said cylindrical protrusion is slightly less than said first diameter of said hollow cylindrical port, wherein said cylindrical protrusion extends at least partially within said hollow cylindrical port when said valve is in said closed position, wherein said second diameter of said first portion of said valve is greater than said first diameter of said hollow cylindrical port, wherein with said valve in said closed position, a first clearance between said hollow cylindrical port and said cylindrical protrusion and a second clearance between said valve and said circular valve seat are sufficiently small to prevent fluid flow through said hollow cylindrical port, a main spring disposed between said housing and said valve which resiliently urges said valve toward said closed position, and a second spring operatively positioned coaxially around said main spring between said valve and said housing which urges said valve away from said circular valve seat, said second spring being dimensioned so that contact between said valve and said circular valve seat is prevented when said valve is in the closed position.

2. The valve assembly as defined in claim 1, wherein said valve is cylindrical in cross section.

3. The valve assembly as defined in claim 1, wherein said valve is cylindrical and cup shaped, and wherein said main spring comprises a helical compression spring positioned at least partially within said valve.

4. The valve assembly as defined in claim 3, wherein said second spring comprises a compression spring disposed around at least a portion of said valve coaxially with said main spring.

5. The valve assembly as defined in claim 3, wherein said second spring comprises an elastomeric cylindrical sleeve disposed around at least a portion of said valve coaxially with said main spring.

6. The valve assembly as defined in claim 1, wherein said circular valve seat and a distal end of said cylindrical protrusion are rounded at substantially the same radius.

7. The valve assembly as defined in claim 1, wherein said valve assembly is used in a fuel pump of an internal combustion engine.

8. The valve assembly as defined in claim 7, wherein said valve assembly comprises an outlet valve of the internal combustion engine.

9. The valve assembly as defined in claim 8, wherein the internal combustion engine is a direct injection engine.

10. The valve assembly as defined in claim 1, wherein said hollow cylindrical port is fluidly connected through the first clearance between said cylindrical protrusion and said hollow cylindrical port, an intermediate fluid chamber formed between said housing and said valve and the second clearance between said valve and said circular valve seat to an outlet for the valve assembly so that fluid pressure decreases gradually from said hollow cylindrical port to said outlet.

11. A fuel delivery system comprising:

a fuel pump having a valve assembly;

a fuel rail; and one or more fuel injector(s), wherein the valve assembly comprises:

a housing forming a hollow cylindrical port of a first diameter having a circular valve seat at an opening thereof, a valve movable along an axis relative to said hollow cylindrical port between an open and a closed position, said valve being circular facing the circular valve seat, said valve having a first portion of a second diameter and a cylindrical protrusion extending from the first portion of a third diameter that is less than said second diameter, wherein said cylindrical protrusion is complementary in shape to said hollow cylindrical port and said third diameter of said cylindrical protrusion is slightly less than said first diameter of said hollow cylindrical port, wherein said cylindrical protrusion extends at least partially within said hollow cylindrical port when said valve is in said closed position, wherein said second diameter of said first portion of said valve is greater than said first diameter of said hollow cylindrical port, wherein with said valve in said closed position, a first clearance between said hollow cylindrical port and said cylindrical protrusion and a second clearance between said valve and said circular valve seat are sufficiently small to prevent fluid flow through said hollow cylindrical port, a main spring disposed between said housing and said valve which resiliently urges said valve toward said closed position, and a second spring operatively positioned coaxially around said valve between said valve and said housing, which urges said valve away from said circular valve seat, said second spring being dimensioned so that contact between said valve and said circular valve seat is prevented when said valve is in the closed position.

12. The fuel delivery system as defined in claim 11, wherein said valve is cylindrical in cross section.

13. The fuel delivery system as defined in claim 11, wherein said valve is cylindrical and cup shaped, and wherein said main spring comprises a helical compression spring positioned at least partially within said valve.

14. The fuel delivery system as defined in claim 13, wherein said second spring comprises a compression spring disposed around at least a portion of said valve coaxially with said main spring.

15. The fuel delivery system as defined in claim 13, wherein said second spring comprises an elastomeric cylindrical sleeve disposed around at least a portion of said valve coaxially with said main spring.

16. The fuel delivery system as defined in claim 11, wherein said valve assembly is used in a fuel pump of an internal combustion engine.

17. The fuel delivery system as defined in claim 16, wherein the internal combustion engine is a direct injection engine.

18. The fuel delivery system as defined in claim 11, wherein said hollow cylindrical port is fluidly connected through the first clearance between said cylindrical protrusion and said hollow cylindrical port, an intermediate fluid chamber formed between said housing and said valve and the second clearance between said valve and said circular valve seat to an outlet for the valve assembly so that fluid pressure decreases gradually from said hollow cylindrical port to said outlet.

19. The valve assembly as defined in claim 1, further comprising an inlet port that is coaxial with the hollow cylindrical port, wherein said cylindrical protrusion has a uniform diameter.

20. The fuel delivery system as defined in claim 11, further comprising an inlet port that is coaxial with the hollow cylindrical port, wherein said cylindrical protrusion has a uniform diameter.

* * * * *